US006578328B2

(12) United States Patent
Bournand et al.

(10) Patent No.: US 6,578,328 B2
(45) Date of Patent: Jun. 17, 2003

(54) DEVICE FOR ANCHORING ONE END OF A STAY TO A BASE

(75) Inventors: Yves Bournand, Montigny le Bretonneux (FR); Adrian Gnägi, Bern (CH); Juan Ayats, Barcelona (ES)

(73) Assignee: VSL International AG, Bern (CH)

( * ) Notice: Subject to any disclaimer, the term of this patent is extended or adjusted under 35 U.S.C. 154(b) by 0 days.

(21) Appl. No.: 10/058,590

(22) Filed: Jan. 28, 2002

(65) Prior Publication Data

US 2002/0108329 A1 Aug. 15, 2002

(30) Foreign Application Priority Data

Jan. 29, 2001 (EP) ..... 01810083

(51) Int. Cl.[7] ..... E04C 5/08
(52) U.S. Cl. ..... 52/223.13; 14/21
(58) Field of Search ..... 52/223.13, 146; 14/26, 21

(56) References Cited

U.S. PATENT DOCUMENTS

| | | | | |
|---|---|---|---|---|
| 3,554,492 | A | * 1/1971 | Beghi | 52/230 |
| 3,956,797 | A | * 5/1976 | Brandestini et al. | 52/223.13 |
| 3,967,421 | A | * 7/1976 | Dufossez | 52/223.13 |
| 4,878,327 | A | 11/1989 | Nutzel | |
| 6,283,451 | B1 | * 9/2001 | Stankus et al. | 52/223.13 |
| 6,381,912 | B1 | * 5/2002 | Sorkin | 52/223.13 |
| 6,414,242 | B2 | * 7/2002 | Schmidt | 52/146 |
| 2001/0039686 | A1 | * 11/2001 | Daiguju et al. | |

FOREIGN PATENT DOCUMENTS

| | | | |
|---|---|---|---|
| DE | 41 18 897 A1 | | 12/1992 |
| DE | 198 01 786 A1 | | 7/1999 |
| EP | 0 323 285 A1 | | 7/1989 |
| FR | 2 794 484 A1 | | 12/2000 |
| GB | 2106947 A | * | 12/1981 |
| WO | WO 00/14357 A2 | | 3/2000 |

* cited by examiner

*Primary Examiner*—Carl D. Friedman
*Assistant Examiner*—Nahid Amiri
(74) *Attorney, Agent, or Firm*—Hahn Loeser & Parks LLP; Stephen L. Grant

(57) ABSTRACT

A device (1) is disclosed for anchoring one end (2A) of a stay (2) to a base (3), this end (2A) of the stay (2) comprising at least two strands (2B) which diverge from its longitudinal axis (2C) in such a way as to come to be anchored in the device (1), these strands (2B) each being made up of a core wire (2D) and a protective sheathing (2E), the device itself being intended to be positioned and immobilised in translation in a bore (3A) provided in the base (3), this device (1) comprising a first rigid unit (4), which:

is delimited transversally by a cylindrical face (4A) and longitudinally by two opposite faces (4B, 4C) substantially orthogonal to the longitudinal axis (4D) of said first unit (4), is traversed by perforations (4E) which, made substantially parallel to its longitudinal axis (4D), are each intended for passage of one end (2F), devoid of sheathing (2E), of a strand (2B) of the stay (2), and each including a bearing surface (4F) intended to co-operate with an immobilisation piece (4G) of such an end (2A) devoid of sheathing (2E), bears at least one tubular element (5C) to cover, over a certain distance (L1) measured from one (4C) of its opposite faces (4B, 4C), the bundle of strands (2B) in a water-tight way at least in its part where the strands (2B) are devoid of sheathing (2E).

44 Claims, 8 Drawing Sheets

DEVICE FOR ANCHORING ONE END OF A STAY TO A BASE

This invention relates to a device for anchoring one end of a stay to a base, generally called an anchor head.

BACKGROUND OF THE ART

Designated by stay is particularly, but not exclusively, a cable used for the construction of suspended and stayed structures, such as suspension bridges, cable-stayed bridges, stadium roofs, buildings, telecommunications towers, etc.

A stay could also be a cable used for an earth anchor. An earth anchor includes a steel tension member, or members, sheath encased and embedded in a hardenable material such as mortar grout poured in a bore hole prepared in the ground.

Such a stay allows parts of a structure to be connected where bases for the anchoring of the ends of this stay have been created beforehand, each through the agency of a device designed for this purpose.

The invention also relates to a method for creating a device of the aforementioned type.

The invention relates more specifically to a device for the anchoring of one end of a stay to a base, this end of the stay comprising at least two strands which diverge from the longitudinal axis of the stay in such a way as to become anchored in the device, the strands each being generally made up of a metallic core wire and a protective sheathing, the device itself being intended to be positioned and immobilised in translation in a bore provided in said base.

To anchor the stay to the base, one starts by mounting the anchoring device on the base in the shouldered bore, then in this device one engages, then immobilises, the ends concerned, one by one, of the strands.

Such a device comprises a first rigid unit which:

- is delimited transversally by a cylindrical face and longitudinally by two opposite faces, substantially orthogonal to the longitudinal axis of said first unit,
- is traversed by perforations which, made substantially parallel to the longitudinal axis of the unit, are each intended for passage of one end, devoid of sheathing, of a strand, and each including a bearing surface intended to co-operate with an immobilisation piece of such an end devoid of sheathing,
- bears at least one tubular element to cover, over a certain distance measured from one of its opposite faces, the bundle of strands in a water-tight way at least in its part where the strands are devoid of sheathing.

In this type of device, the length of the tubular element, referred to as the transition pipe, is such that it makes the device cumbersome to mount.

In the prior art, to place the device in the bore of the base and abutting against the shouldered face of this bore, it often happens that it is not possible to mount it by engaging it in the bore, against its shouldered face.

In the prior art, the mounting must be achieved in reverse manner, that is to say in a direction opposite to that in which the stay must be stressed, and stops, clamping jaws making up a so-called split shim, must be installed around the device to allow it to find, ultimately, support against the shouldered face of the bore.

These technical features increase the manufacturing price of these creations.

One object of the invention is to obtain an anchoring device which overcomes this drawback.

Likewise a drawback with the state-of-the-art devices is that the ends of the strands which have had their sheathing removed are not protected against oxidation through the device during the entire duration of mounting, which can amount to between several hours and several months.

In fact, the strands are mounted one by one, and the tubular element which must finally cover the bundle of strands in a water-tight way does not ensure individual protection of these strands during their mounting.

One solution can consist in protecting the strands by metallisation, but this method increases the manufacturing cost.

An object of the invention is to obtain a device which makes it possible to protect the part of each strand devoid of sheathing against oxidation during and after installation of the strands.

An additional object of the invention is to obtain a device which can be prefabricated without posing problems with respect to transport to the place of utilisation and subsequent mounting on the base.

Another object of the invention is to obtain a device which makes it possible to damp the vibrations and bending constraints of each strand, and this individually.

Another object is to obtain a device in which it is possible to check the system of protection for each strand during service.

Finally, a further object of the invention is to obtain a device of standardised length.

SUMMARY OF THE INVENTION

To achieve these objects, the invention has as its subject matter a device of the aforementioned type, in particular characterised in that, in the state of being separated from the base, the device comprises a second substantially cylindrical, rigid unit which:

- is rigidly connected to said first unit,
- has at least two independent channels which, running substantially parallel and in each case in the prolongation of a perforation of the first unit, each have the one of their ends connected in a water-tight way to the first unit and the other having,
  - a first locally water-tight pressing surface around the sheath covering the core wire of a strand, when it is engaged in the channel,
  - a second surface of lateral support for the sheath of a strand in view of the deviation of said strand from the axis of the channel, which receives it, toward the axis of the end of the stay.

BRIEF DESCRIPTION OF THE DRAWINGS

The invention will be better understood from reading the following description, given by way of non-limiting example, with reference to the attached drawings.

DETAILED DESCRIPTION OF THE INVENTION

Figure 1:
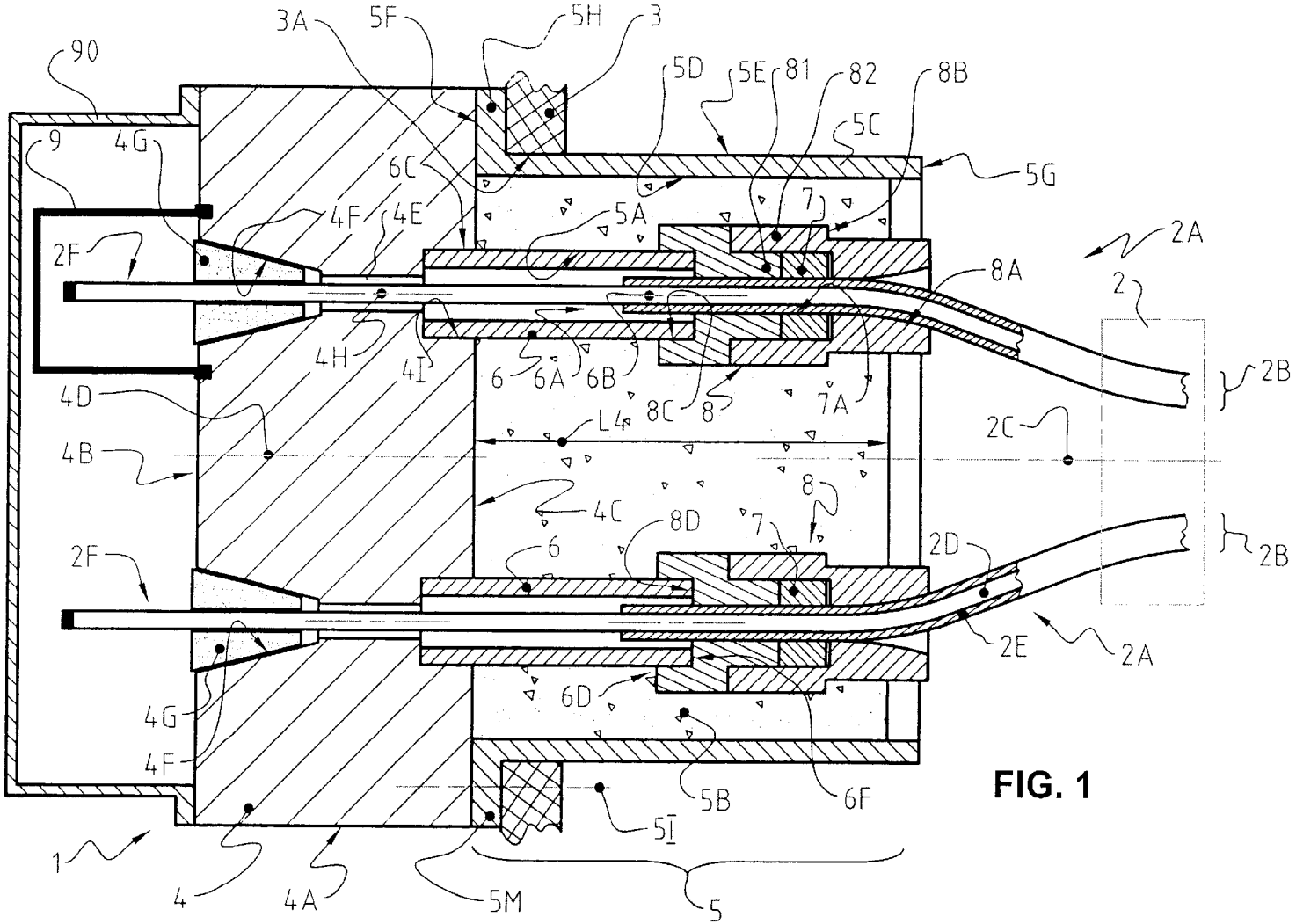
FIG. 1 is a longitudinal section of a non-adjustable anchoring device according to the invention in which certain constituent parts have been omitted in order to show more clearly the details of the device.

Referring to the drawings, one sees a device 1 for anchoring one end 2A of a stay 2 to a base 3, this end 2A of the stay 2 comprising at least two strands 2B which diverge from the longitudinal axis 2C of the stay 2 in such a way as to come to be anchored in the device 1, these strands 2B each being made up of a core wire 2D and a protective sheathing 2E, the device itself being intended to be positioned and immobilised in translation in a bore 3A provided in the base 3.

Figure 2:
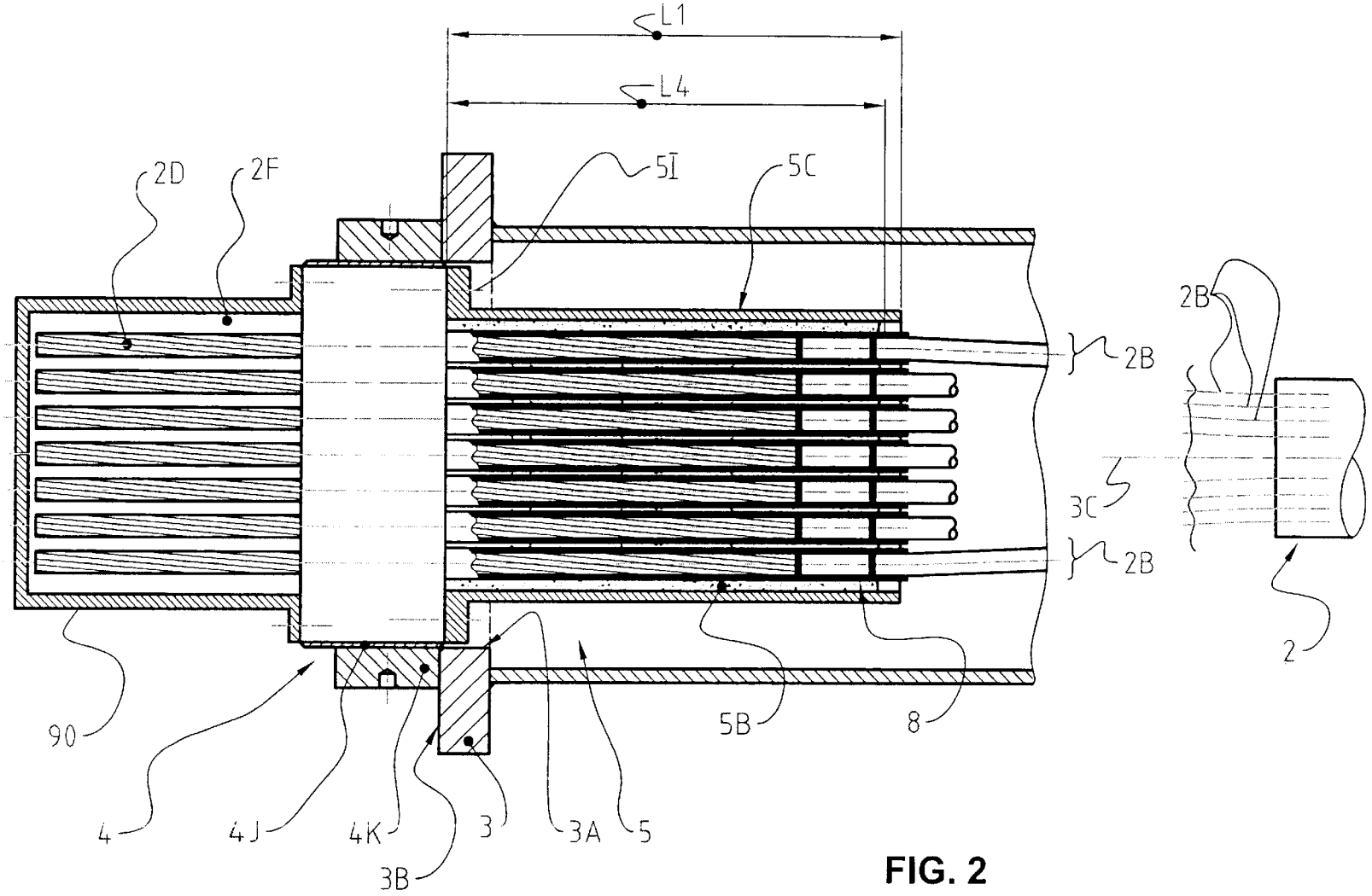
FIGS. 2 and 3 are a longitudinal section of two different embodiments of an adjustable anchoring device according to the invention.
Figure 3:
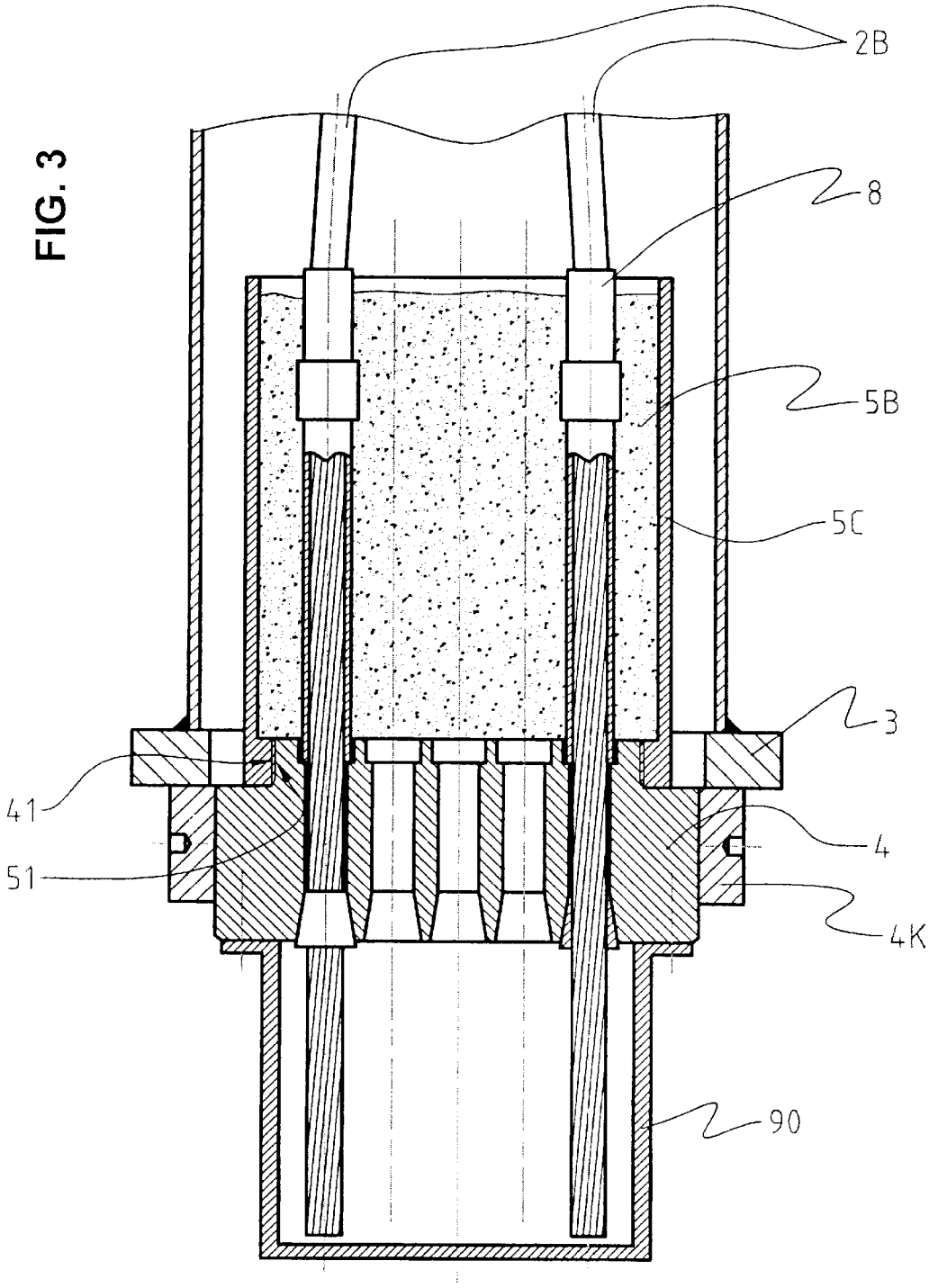

By way of example, in FIG. 1, the device shown is of non-adjustable type in axial position in the bore 3A of the base 3, whereas in FIGS. 2 and 3, the device shown is of adjustable type in axial position in the bore 3A of the base 3.

As can be seen in the drawing, the device 1 comprises a first rigid unit 4, which:

- is delimited transversally by a cylindrical face 4A and longitudinally by two opposite faces 4B, 4C substantially orthogonal to the longitudinal axis 4D of said first unit 4,
- is traversed by perforations 4E which, made substantially parallel to the longitudinal axis 4D of the unit 4, are each intended for passage of one end 2F, devoid of sheathing 2E, of a strand 2B of the stay 2, and each including a bearing surface 4F intended to co-operate with an immobilisation piece 4G of such an end 2A devoid of sheathing 2E,
- bears at least one tubular element 5C to cover, over a certain distance L1 measured from one 4C of its opposite faces 4B, 4C, the bundle of strands 2B in a water-tight way at least in its part where the strands 2B are devoid of sheathing 2E.

For example, as seen in FIG. 2, the outer cylindrical surface 4A of the first unit 4 can have at least locally a threading 4J with which a threaded ring 4K co-operates, intended to be supported on a shoulder 3B provided around the bore 3A made in the base 3.

The screwing or unscrewing of the ring 4K allows adjustment of the position of the anchoring device 1 in the bore 3A of the base 3 and, consequently, adjustment of the tension of the stay 3.

Noteworthy is that in the state of being separated from the base 3, the device 1 comprises a substantially cylindrical second rigid unit 5 which:

- is rigidly connected to said first unit 4,
- has at least two independent channels 6A which, running substantially parallel and in each case in the prolongation of a perforation 4E of the first unit 4, each have the one 6C of their ends 6C, 6D connected in a water-tight way to the first unit 4 and the other having,
  - a first locally water-tight pressing surface 7A around the sheath 2E covering the core wire 2D of a strand 2B, when it is engaged in the channel 6A,
  - a second surface 8A of lateral support for the sheath 2E of a strand 2B in view of the deviation of this strand from the axis 6B of the channel 6A, which receives it, toward the axis 2C of the end 2A of the stay 2.

With these means the device makes possible protection against oxidation of the part of each strand 2B which is devoid of sheathing 2E, and this during and after the successive installation of each of said strands 2B.

These technical features likewise make it possible to provide stand-by sites for the strands 2B, i.e. sites in which it is possible to mount strands 2B later on, for example to increase the resistance of a structure.

Noteworthy is that the second unit 5 comprises a cylindrical body 5B traversed by a plurality of holes 5A each accommodating a tubular piece 6 which:

- at a first end 6C, is connected to the first unit 4 in a water-tight way such that its channel 6A is situated substantially in the axis 4H of a perforation 4E of said first unit 4,
- at a second end 6D, bears said first locally water-tight pressing surface 7A around the sheath 2E and said second surface 8A of lateral support for the sheath 2E.

These technical features make it possible to really ensure a water-tightness strand by strand.

With a device of this type, it is possible to replace one or more strands without affecting the water-tightness of the strands in place.

It is likewise possible to check selectively the water-tightness of each strand.

It is to be noted that the device according to the invention (FIG. 1) comprises a covering 90 which is intended to cover in a water-tight manner the set of immobilisation pieces 4G of ends 2A, of strands 2B, which are accessible from the one 4B of the opposite faces 4B, 4C of the first unit 4.

It is to be noted moreover that the device according to the invention, as shown in FIG. 1, can comprise a plurality of caps 9 which are each intended to cover in a water-tight manner an assembly which, made up of an immobilisation piece 4G of an end 2A of strand 2B and said end 2A of strand 2B, is accessible from the one 4B of the opposite faces 4B, 4C of the first unit 4.

For example, each cap 9 co-operates in a water-tight way with a seat of water-tightness built around the entrance of the bearing surface 4F.

It is possible for the set of caps 9 itself to be covered by the covering 90.

Noteworthy is that the second end 6D of each tubular piece 6 bears an element 8, referred to as a drilled element 8, which:

- is connected in a water-tight manner to the second end 6D of said tubular piece,
- has an axial channel intended for the passage of a strand 2B, in particular covered by a sheath 2E,
- accommodates an annular element 7, made of elastic, deformable material, which has a bore of a diameter compatible with the passage of the sheath 2E, but whose surface 7A constitutes the locally water-tight pressing surface around this sheath 2E of a strand 2B,
- bears the lateral support surface 8A for the sheath 2E, surface 8A being provided in view of the deviation of the strand 2B.

The grouping together of the surfaces fulfilling the functions of water tightness and of deviation on a drilled element 8, which is installed on a tubular piece 6, makes it possible to construct a device in an economical way.

In fact, the drilled elements 8 can be used, for example, with tubular pieces 6 of different lengths L2.

Noteworthy is that each tubular piece 6 is inserted by its first end 6C into a bore 41 reserved for this purpose in the first unit 4 in such a way that the channel 6A of the respective tubular piece 6 is situated substantially in the axis 4H of a perforation 4E of said first unit 4.

This ensures water-tightness and facilitates the mounting of the device.

These features are exploited in the method described later on.

Noteworthy moreover is that each drilled element 8 has, as shown in FIG. 1 and FIGS. 4 to 7:

- a first bore 8C, dimensioned to allow a water-tight fit on a second end 6D of a tubular piece 6, and a bearing surface 8D to limit the amount of axial insertion on said end 6D, and this by abutting on the end face 6F of this end 6D, and
- a bearing surface 8E where the annular element 7 is retained that accommodates the locally water-tight pressing surface 7A around the sheath 2E of a strand 2B.

Figure 4:
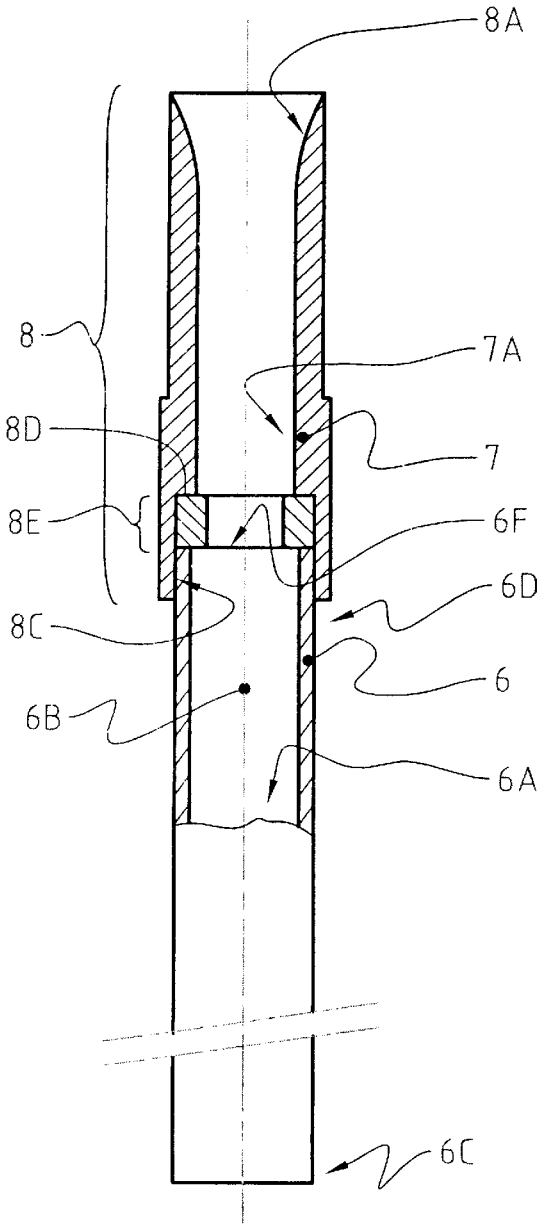
FIGS. 4 to 10 show diagrammatically, the different stages in producing a device according to the invention.

In a first embodiment shown in FIG. 4:

the bearing surface 8E, in which the water-tight annular element 7 around the sheath 2E of a strand 2B is retained, is made up of a portion of the surface of the first bore 8C dimensioned for water-tight fit on a second end 6D of a tubular piece 6, this bearing surface 8E being located in the vicinity of the bearing surface 8D of the drilled element 8 which is intended to limit the axial insertion with said end 6D of the tubular piece 6, the annular element 7, which accommodates the water-tight support surface 7A around the sheath 2E of a strand 2B, is dimensioned to fit in the bore 8C of the drilled element 8 in such a way as to be able to be placed between, on the one hand, the bearing surface 8D of this element 8 which is intended to limit its insertion on the end 6D of the tubular piece 6, and, on the other hand, the end face 6F of this end 6D.

Figure 5:
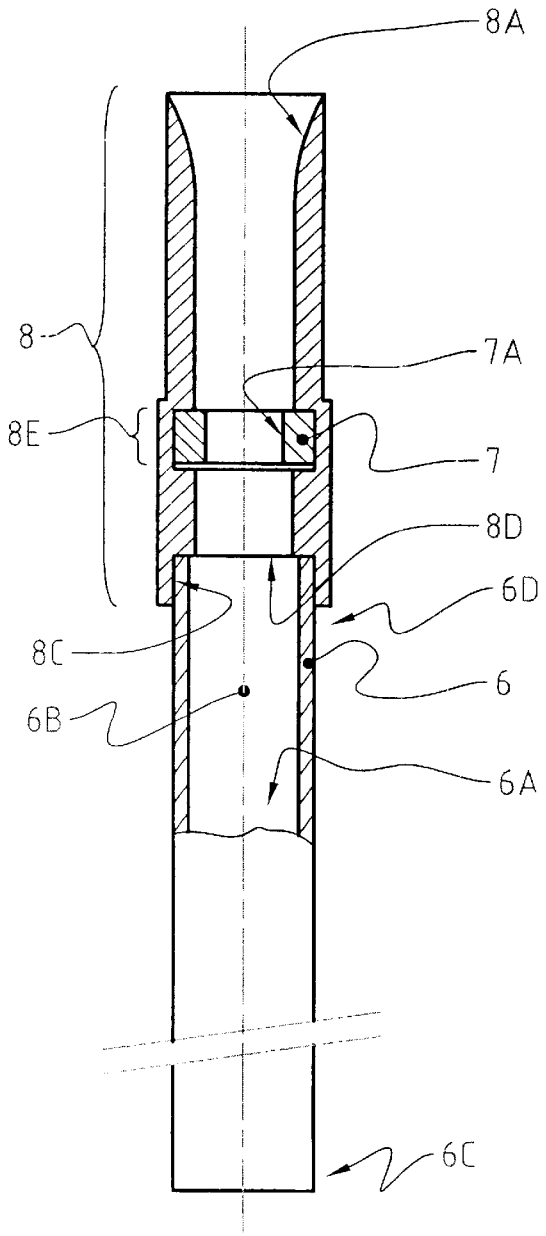

In a second embodiment, shown in FIG. 5, the bearing surface 8E intended to receive the water-tight annular support element 7 around the sheath 2E of a strand 2B, consists in an annular groove made in the wall of the drilled element 8, and this being between said first bore 8C and the surface 8A of lateral support for the sheath 2E, provided in view of the deviation of the strand 2B.

Figure 6:
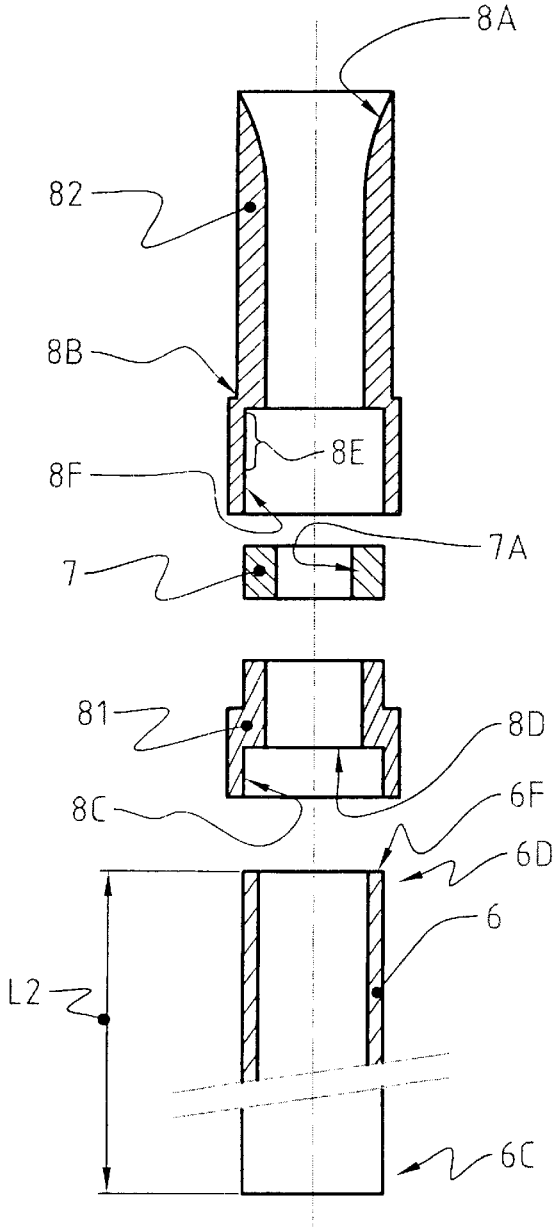
Figure 7:
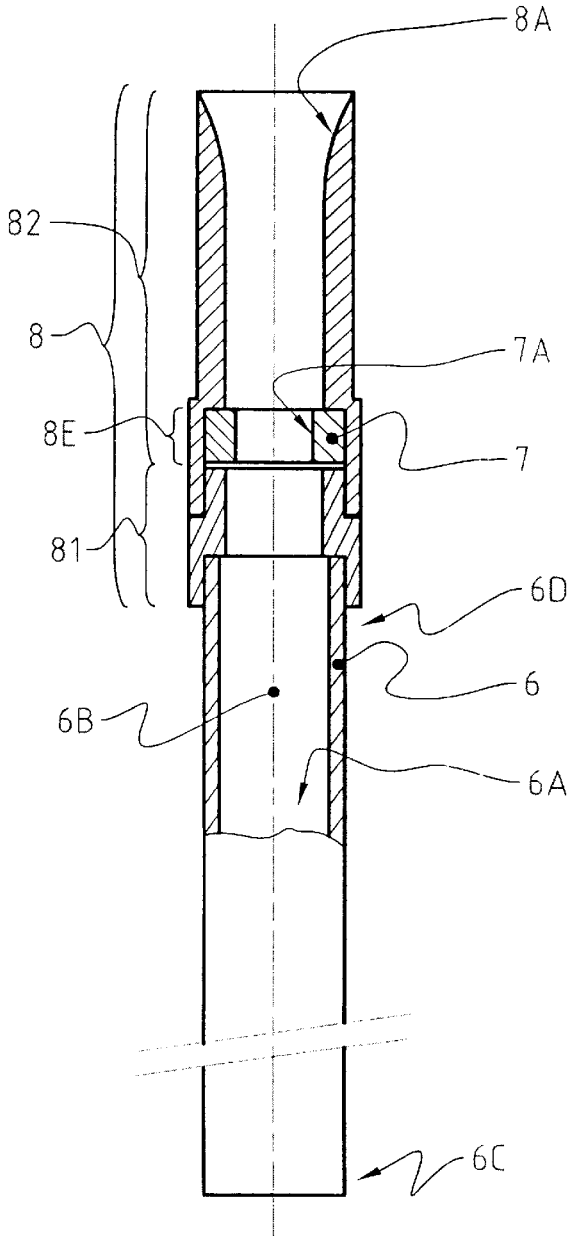

In a third embodiment, shown in FIGS. 6 and 7, the preferred embodiment, the drilled element 8:

on the one hand, is made up of at least two parts 81, 82, namely, a first part 81 which comprises the first bore 8C dimensioned to allow the water-tight fit on an end 6D of a tubular piece 6 and a bearing surface 8D to limit the axial insertion on said end 6D by pressing at least indirectly on the end face 6F of that end 6D, and a second part 82 which comprises the surface 8A of lateral support for the sheath 2E, surface 8A being provided in view of the deviation of the strand 2B, and on the other hand, these first and second parts 81, 82 are provided with bearing surfaces for assembly through axial insertion, which limit the axial insertion in such a way as to reserve an accommodation for the water-tight annular support element 7 around the sheath 2E of a strand 2B that is to say a bearing surface 8E where the annular element 7 is retained.

The term drilled does not refer to any specific method to obtain the bores 8C and 8F.

In a noteworthy way, each drilled element 8 has at least one stop 8B oriented to resist the material making up the second unit 5 and impede its extraction from this second unit 5.

In a noteworthy way, the second unit 5 comprises:

an outer tubular element 5C formed by a rigid tubular wall delimited by an inner cylindrical face 5D, an outer cylindrical face 5E and two opposite annular end faces 5F, 5G, an inner cylindrical element 5B formed by a core 5B of material in which channels 6A are provided, the channels being intended to prolong the perforations 4E of the first unit 4, and which closely abuts, on the one hand, against the inner face 5D of the tubular element 5C and, on the other hand, against the first unit 4.

These technical features make it possible to transfer efficiently, on the first unit 4 and thus on the base, forces which arise through the collection of strands, these forces being oriented transversely to the device.

In a manner which is also noteworthy, the outer tubular element 5C makes contact with the first unit 4 through the one 5F of its annular end faces 5F, 5G, and has at this end a flange 5H, shown in FIGS. 1 and 2, which protrudes with respect to its outer cylindrical face 5E, and bears support surfaces for anchoring elements 51 in the said first unit 4.

The anchoring elements preferably consist of screws the bodies of which traverse the flange at its thickness to become anchored in a threaded boring reserved for that purpose in the first unit and whose heads abut on an open face of the flange.

In another noteworthy manner, shown in FIG. 3, the outer tubular element 5C and the first unit 4 are connected by threaded surfaces 41, 51.

In one noteworthy embodiment, the inner cylindrical element 5B can be formed by a core 5B of material having vibration-damping features.

For example, the inner cylindrical element 5B is formed by a core 5B of material obtained through hardening of at least one material introduced in the rigid tubular element 5C around tubular pieces 6 and in such a way as to confine the drilled elements 8.

In one non-limiting embodiment example, the material used can comprise high-strength concrete.

In particular, the longitudinal dimensions:

L1, of the outer tubular element 5C,

L2, of each tubular piece 6,

L3, of each boring 41 reserved in the first unit 4 to accept a tubular piece 6, L4, of the inner cylindrical element 5B, are determined in such a way that each drilled element 8, its stop 8B intended to impede its extraction from the second unit 5, resists the material making up said second unit 5 without said material impeding the passage of a strand 2B.

As has already been mentioned, the invention also relates to a method for obtaining a device 1 for anchoring an end 2A of a stay 2 to a base 3, this end 2A of the stay 2 comprising at least two strands 2B which diverge from the longitudinal axis 2C of the stay in such a way as to become anchored in the device 1, said strands 2B each being made up of a core wire 2D and a protective sheathing 2E, the device being intended to be positioned and immobilised in translation in a boring 3A provided in the base 3.

According to this method:

a first unit 4 is provided which is, delimited transversally by a cylindrical face 4A and longitudinally by two opposite faces 4B, 4C substantially orthogonal to the longitudinal axis 4D of the said first unit 4, traversed by perforations 4E, made substantially parallel to its longitudinal axis 4D, which are each intended for the passage of an end 2F of a strand 2B of stay 2 devoid of sheathing 2E and each comprising a bearing surface 4F intended to cooperate with an immobilisation piece 4G of such an end 2A devoid of sheathing 2E, and bears at least one tubular element 5C to cover, over a certain distance measured from one of its opposite faces, the bundle of strands 2B in a water-tight way at least in its part where the strands are devoid of sheathing, a second rigid unit 5, substantially cylindrical, is built against face 4C, of said opposite faces 4B, 4C, of the first unit 4, which is the face intended to bear at least one tubular element 5C to cover the bundle of strands 2B at least in its part where the strands 2B are devoid of sheathing 2E, which second rigid unit 5 is rigidly connected to said first unit 4, this second unit having at least two channels 6A which, extend substantially parallel, each in the prolongation of a perforation 4E of the first unit 4, each have one 6B of their ends which is connected in a water-tight way to the first unit 4 and the other end bearing, a first locally water-tight pressing surface 7A around the sheath 2E covering the core wire 2D of a strand 2B when it is engaged in the channel 6A, and a second surface 8A of lateral support for the sheath 2E of a strand 2B provided with a view to the deviation of this strand from the axis 6B of the channel 6A which receives it toward the axis 2C of the end 2A of the stay 2.

Figure 8:
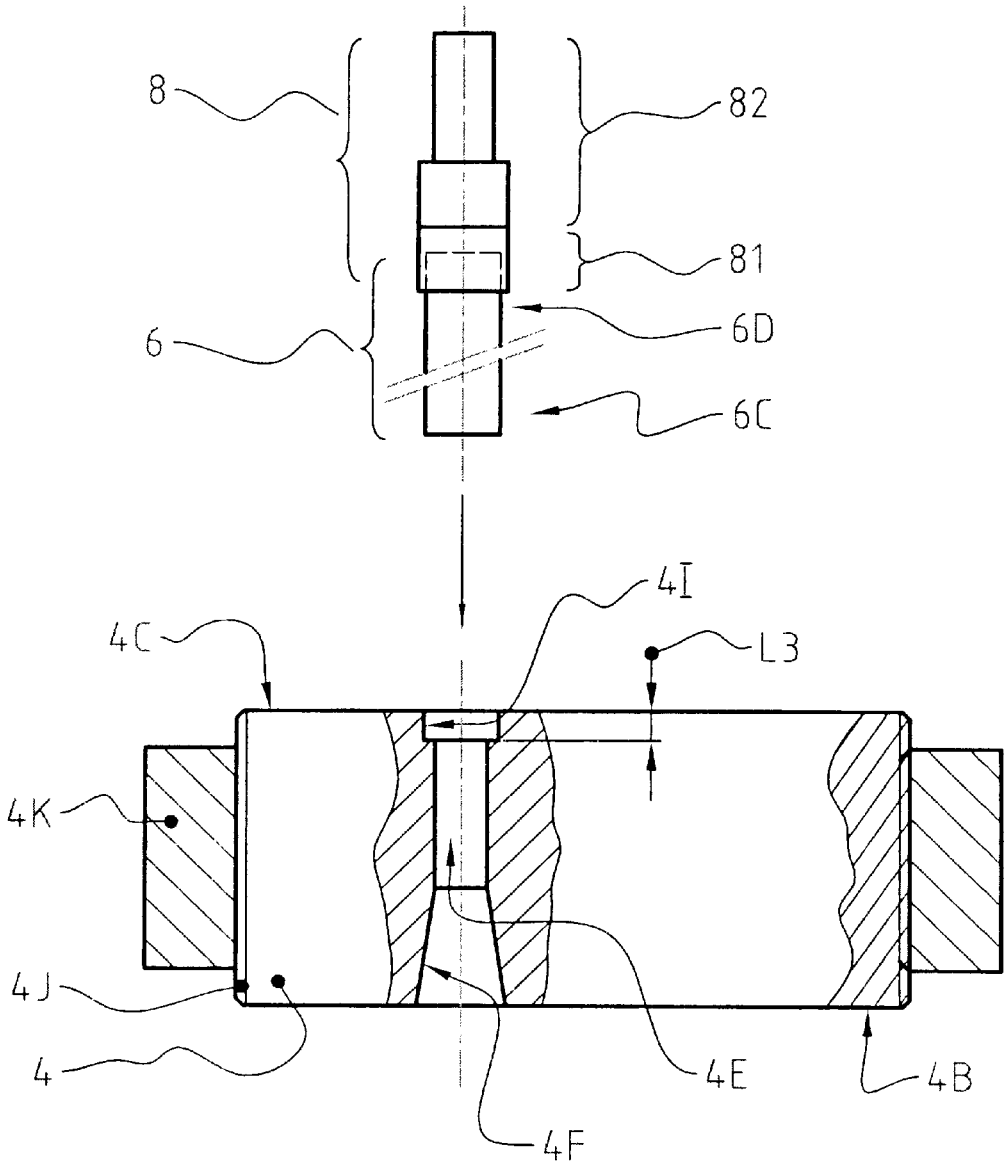
Figure 9:
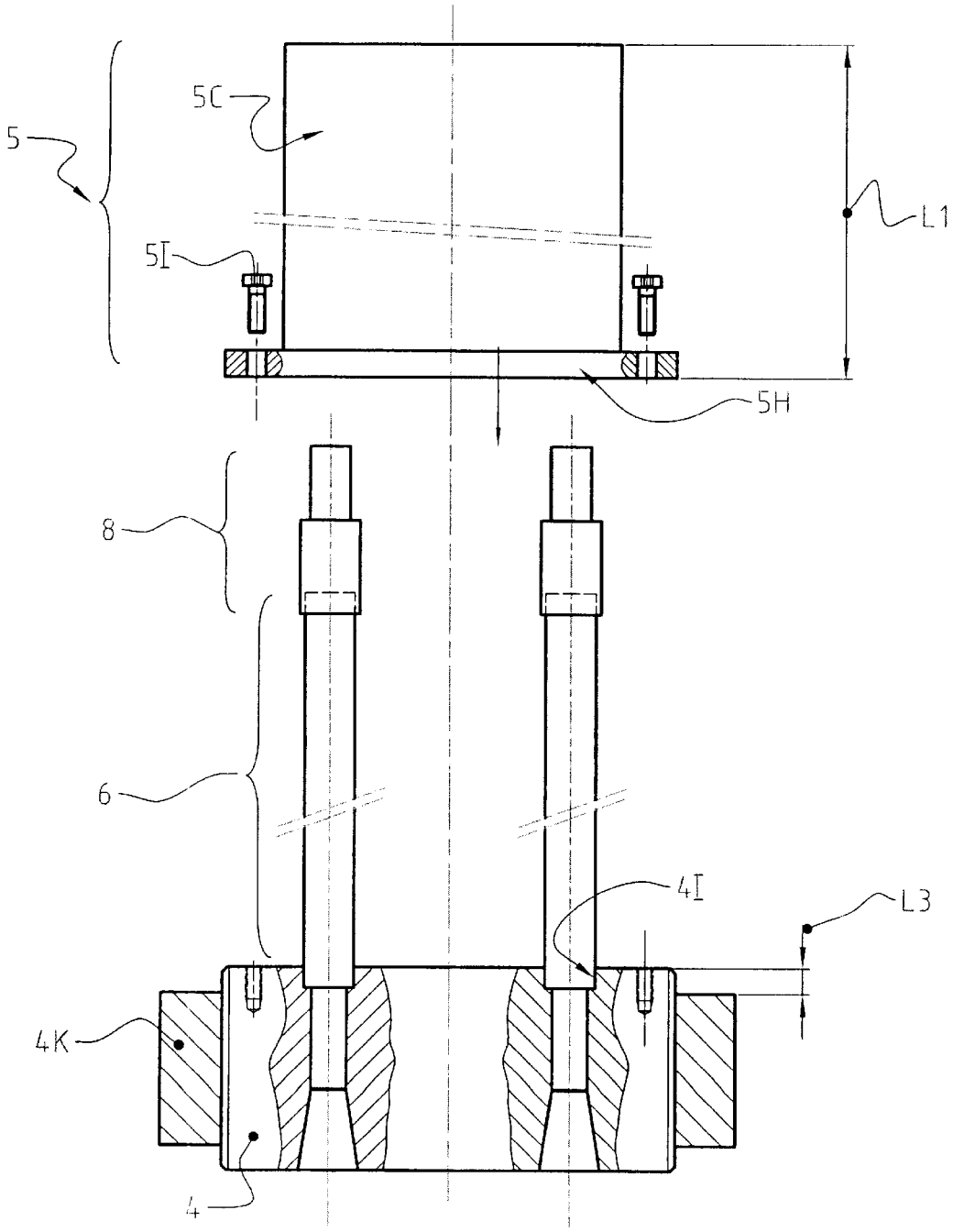
Figure 10:
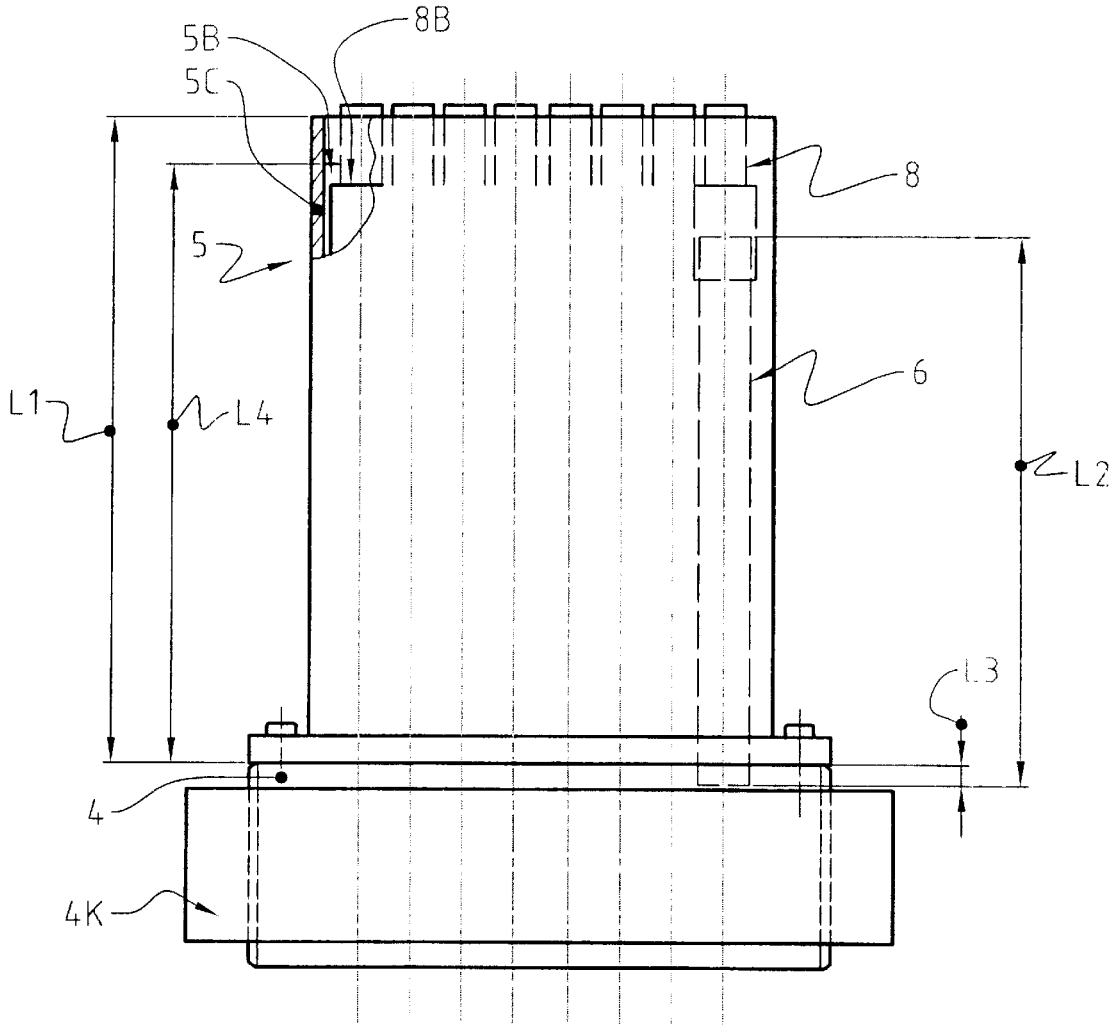

Likewise according to the inventive method, to construct the second unit 5:

tubular pieces 6 are provided, as shown in FIG. 8, then each of these pieces is connected by its end to the first unit 4, and this is done in a water-tight way and such that the channel 6A of each tubular piece 6 is situated in the axis 4H of a perforation 4E of the said first unit 4, an outer tubular element 5C is provided formed by a rigid tubular wall delimited by an inner cylindrical face 5D, an outer cylindrical face 5E and two opposite, annular end faces 5F, 5G, and, as shown in FIG. 9, this tubular element is connected in a rigid way to the first unit 4 such that it delimits a volume around the tubular pieces 6, elements 8, referred to as drilled elements 8, are provided, each of which bears, on the one hand, a surface 8A of lateral support for the sheath 2E provided in view of the deviation of the strand 2B, and, on the other hand, a locally water-tight pressing surface 7A, as shown in FIGS. 4 to 7, around the sheath 2E of a strand 2B, and at the very latest after having connected the outer tubular element 5C to the first unit 4, the second end 6D of each tubular piece 6 is equipped with one of said drilled elements 8, a material is provided, which can be cast in a mold and can harden, then, as shown in FIG. 10, this material is introduced into the internal volume of the tubular element 5C and around the tubular pieces 6 in such a way as to confine said drilled elements 8 without obstructing them.

In a preferred embodiment of the inventive method:

tubular pieces 6 and drilled elements 8 are provided which each bear, on the one hand, a surface 8A of lateral support for the sheath 2E, provided in view of the deviation of a strand 2B, and, on the other hand, a locally water-tight pressing surface 7A, as shown in FIGS. 4 to 7, around the sheath 2E of a strand 2B, and one 6D of said ends is equipped with one of these said drilled elements 8, the tubular pieces 6, thus equipped with drilled elements 8 at the one 6D of their ends, are then each connected by their other end to the first unit 4, and this is done in a water-tight way and such that the channel 6A of each tubular piece 6 is situated in the axis 4H of a perforation 4E of said first unit 4, an outer tubular element 5C is provided, formed by a rigid tubular wall delimited by an inner cylindrical face 5D, an outer cylindrical face 5E and two opposite annular end faces 5F, 5G, and, as shown in FIG. 10, said tubular element is connected in a rigid way to the first unit 4 such that it delimits a volume around the tubular pieces 6; and a material is provided, which can be cast in a mold and can harden, which is then, as shown in FIG. 10, introduced into the internal volume of the outer tubular element 5C and around the tubular pieces 6 in such a way as to confine the drilled elements 8 without obstructing them.

What is claimed is:

1. A device for anchoring one end of a stay to a base having a bore therein, said stay end comprising at least two strands that diverge from a longitudinal axis thereof to be anchored in the device, said strands each being made up of a core wire and a protective sheathing, said device intended to be positioned and immobilized in translation in the bore, said device comprising:

a first rigid unit, and a second rigid unit, said second rigid unit being substantially cylindrical;

wherein said first rigid unit is delimited transversally by a cylindrical face and longitudinally by two opposite faces that are substantially orthogonal to a longitudinal axis thereof;

wherein said first rigid unit is traversed by perforations that, made substantially parallel to said longitudinal axis, each pass an end, devoid of sheathing, of one said strand, and which each include a bearing surface to co-operate with an immobilization piece on such an unsheathed strand end;

wherein said first rigid unit further bears at least one tubular element to cover, over a certain distance measured from one of the opposite faces, the strands in a water-tight way at least in the part of the strands that are devoid of sheathing; and wherein the second rigid unit is rigidly connected to said first unit, and wherein the second rigid unit has at least two independent channels that, running substantially parallel and in each case in the prolongation of one said perforation of the first rigid unit, each have a first end thereof connected in a water-tight way to the first rigid unit and a second end thereof having a first locally water-tight pressing surface around the sheath of one said strand, when said strand is engaged in the channel, the second channel end having a second surface of lateral support for the sheath of the strand in view of the deviation of said strand from an axis of the channel, which receives the strand, toward the longitudinal axis of the stay end.

2. The device of claim 1, wherein the second rigid unit comprises a cylindrical body traversed by a plurality of holes, each said hole accommodating a tubular piece, wherein the tubular piece is connected at a first end thereof to the first rigid unit in a water-tight way such that a channel therein is situated substantially in an axis of one said perforation of said first rigid unit, and wherein the tubular piece bears, at a second end thereof, said first locally water-tight pressing surface around the sheath and said second surface of lateral support for the sheath.

3. The device of claim 2, wherein the second end of each said tubular piece bears a drilled element, wherein the drilled element is connected in a water-tight manner to the second end of the tubular piece, wherein the drilled element has an axial channel to pass one said strand, in particular covered by a sheath, wherein the drilled element accommodates an annular element, made of an elastic, deformable material, which has a bore of a diameter compatible with the passage of the sheath, but with a surface that constitutes the locally water-tight pressing surface around the sheath, and wherein the drilled element bears the lateral support surface for the sheath.

4. The device of claim 2, wherein each said tubular piece is inserted by its first end into a bore reserved for this purpose in the first rigid unit so that the channel of the respective tubular piece is situated substantially in the axis of one said perforation of said first rigid unit.

5. The device of claim 3, wherein each said tubular piece is inserted by its first end into a bore reserved for this purpose in the first rigid unit so that the channel of the respective tubular piece is situated substantially in the axis of one said perforation of said first rigid unit.

6. The device of claim 3, wherein each said drilled element comprises:

a first bore, dimensioned to allow a water-tight fit on the second end of one said tubular piece, and a bearing surface to limit the amount of axial insertion on said end, and this by abutting on an end face thereof, and a bearing surface where the annular element is retained that accommodates the locally water-tight pressing surface around the strand sheath of a strand.

7. The device of claim 4, wherein each said drilled element comprises:

a first bore, dimensioned to allow a water-tight fit on the second end of one said tubular piece, and a bearing surface to limit the amount of axial insertion on said end, and this by abutting on an end face thereof, and a bearing surface where the annular element is retained that accommodates the locally water-tight pressing surface around the strand sheath of a strand.

8. The device of claim 5, wherein each said drilled element comprises:

a first bore, dimensioned to allow a water-tight fit on the second end of one said tubular piece, and a bearing surface to limit the amount of axial insertion on said end, and this by abutting on an end face thereof, and a bearing surface where the annular element is retained that accommodates the locally water-tight pressing surface around the strand sheath of a strand.

9. The device of claim 6, wherein:

the bearing surface, in which the water-tight annular element around the strand sheath is retained, is made up of a portion of the surface of the first bore dimensioned for water-tight fit on the second end of one said tubular piece, the bearing surface being located in the vicinity of the bearing surface of the drilled element which is intended to limit the axial insertion with said end of the tubular piece, the annular element, which accommodates the water-tight support surface around the strand sheath of a strand, is dimensioned to fit in the bore of one said drilled element so that it can be placed between, on the one hand, the bearing surface of the element, which is intended to limit its insertion on the end of the one said tubular piece, and, on the other hand, the end face thereof.

10. The device of claim 7, wherein:

the bearing surface, in which the water-tight annular element around the strand sheath is retained, is made up of a portion of the surface of the first bore dimensioned for water-tight fit on the second end of one said tubular piece, the bearing surface being located in the vicinity of the bearing surface of the drilled element which is intended to limit the axial insertion with said end of the tubular piece, the annular element, which accommodates the water-tight support surface around the strand sheath of a strand, is dimensioned to fit in the bore of one said drilled element so that it can be placed between, on the one hand, the bearing surface of the element, which is intended to limit its insertion on the end of the one said tubular piece, and, on the other hand, the end face thereof.

11. The device of claim 8, wherein:

the bearing surface, in which the water-tight annular element around the strand sheath is retained, is made up of a portion of the surface of the first bore dimensioned for water-tight fit on the second end of one said tubular piece, the bearing surface being located in the vicinity of the bearing surface of the drilled element which is intended to limit the axial insertion with said end of the tubular piece, the annular element, which accommodates the water-tight support surface around the strand sheath of a strand, is dimensioned to fit in the bore of one said drilled element so that it can be placed between, on the one hand, the bearing surface of the element, which is intended to limit its insertion on the end of the one said tubular piece, and, on the other hand, the end face thereof.

12. The device of claim 9, wherein:

the bearing surface for receiving the water-tight annular support element around the strand sheath comprises an annular groove made in the wall of the drilled element, and this being between said first bore and the surface of lateral support for the sheath, provided in view of the deviation of the strand.

13. The device of claim 10, wherein:

the bearing surface for receiving the water-tight annular support element around the strand sheath comprises an annular groove made in the wall of the drilled element, and this being between said first bore and the surface of lateral support for the sheath, provided in view of the deviation of the strand.

14. The device of claim 11, wherein:

the bearing surface for receiving the water-tight annular support element around the strand sheath comprises an annular groove made in the wall of the drilled element, and this being between said first bore and the surface of lateral support for the sheath, provided in view of the deviation of the strand.

15. The device of claim 9, wherein the drilled element comprises:

a first part, which comprises the first bore dimensioned to allow the water-tight fit on an end of a tubular piece and a bearing surface to limit the axial insertion on said end by pressing at least indirectly on the end face of that end, and a second part, which comprises the surface of lateral support for the sheath, said surface being provided in view of the deviation of the strand, and wherein said first and second parts are provided with bearing surfaces for assembly through axial insertion, which limit the axial insertion in such a way as to reserve an accommodation for the water-tight annular support element around the strand sheath, that is to say, a bearing surface where the annular element is retained.

16. The device of claim 10, wherein the drilled element comprises:

a first part, which comprises the first bore dimensioned to allow the water-tight fit on an end of a tubular piece and a bearing surface to limit the axial insertion on said end by pressing at least indirectly on the end face of that end, and a second part, which comprises the surface of lateral support for the sheath, said surface being provided in view of the deviation of the strand, and wherein said first and second parts are provided with bearing surfaces for assembly through axial insertion, which limit the axial insertion in such a way as to reserve an accommodation for the water-tight annular support element around the strand sheath, that is to say, a bearing surface where the annular element is retained.

17. The device of claim 11, wherein the drilled element comprises:

a first part, which comprises the first bore dimensioned to allow the water-tight fit on an end of a tubular piece and a bearing surface to limit the axial insertion on said end by pressing at least indirectly on the end face of that end, and a second part, which comprises the surface of lateral support for the sheath, said surface being provided in view of the deviation of the strand, and wherein said first and second parts are provided with bearing surfaces for assembly through axial insertion, which limit the axial insertion in such a way as to reserve an accommodation for the water-tight annular support element around the strand sheath, that is to say, a bearing surface where the annular element is retained.

18. The device of claim 3, wherein each said drilled element further comprises:

at least one stop oriented to resist the material making up the second rigid unit and impede its extraction therefrom.

19. The device of claim 4, wherein each said drilled element further comprises:

at least one stop oriented to resist the material making up the second rigid unit and impede its extraction therefrom.

20. The device of claim 5, wherein each said drilled element further comprises:

at least one stop oriented to resist the material making up the second rigid unit and impede its extraction therefrom.

21. The device of claim 6, wherein each said drilled element further comprises:

at least one stop oriented to resist the material making up the second rigid unit and impede its extraction therefrom.

22. The device of claim 7, wherein each said drilled element further comprises:

at least one stop oriented to resist the material making up the second rigid unit and impede its extraction therefrom.

23. The device of claim 8, wherein each said drilled element further comprises:

at least one stop oriented to resist the material making up the second rigid unit and impede its extraction therefrom.

24. The device of claim 9, wherein each said drilled element further comprises:

at least one stop oriented to resist the material making up the second rigid unit and impede its extraction therefrom.

25. The device of claim 10, wherein each said drilled element further comprises:

at least one stop oriented to resist the material making up the second rigid unit and impede its extraction therefrom.

26. The device of claim 11, wherein each said drilled element further comprises:

at least one stop oriented to resist the material making up the second rigid unit and impede its extraction therefrom.

27. The device of claim 3, wherein the second rigid unit comprises:

an outer tubular element, formed by a rigid tubular wall delimited by an inner cylindrical face, an outer cylindrical face and two opposite annular end faces, an inner cylindrical element formed by a core of material in which channels are provided, the channels being intended to prolong the perforations of the first rigid unit, and wherein the inner cylindrical element closely abuts, on the one hand, against the inner face of the outer tubular element and, on the other hand, against the first rigid unit.

28. The device of claim 27, wherein the outer tubular element contacts the first rigid unit through the one of its annular end faces, and has at this end a flange that protrudes with respect to its outer cylindrical face, and bears support surfaces for anchoring elements in the first rigid unit.

29. The device of claim 27, wherein the outer tubular element and the first rigid unit are connected by threaded surfaces.

30. The device of claim 27, wherein the inner cylindrical element is formed by a core of material having vibration-damping features.

31. The device of claim 28, wherein the inner cylindrical element is formed by a core of material having vibration-damping features.

32. The device of claim 29, wherein the inner cylindrical element is formed by a core of material having vibration-damping features.

33. The device of claim 27, wherein the inner cylindrical element is formed by a core of rigid material.

34. The device of claim 28, wherein the inner cylindrical element is formed by a core of rigid material.

35. The device of claim 29, wherein the inner cylindrical element is formed by a core of rigid material.

36. The device of claim 30, wherein the inner cylindrical element is formed by a core of rigid material.

37. The device of claim 31, wherein the inner cylindrical element is formed by a core of rigid material.

38. The device of claim 32, wherein the inner cylindrical element is formed by a core of rigid material.

39. The device of claim 27, wherein the inner cylindrical element is formed by a core of material obtained through hardening of at least one material introduced in the rigid tubular element around tubular pieces and in such a way as to confine the drilled elements.

40. The device of claim 39, wherein:

a longitudinal dimension of the outer tubular element, a longitudinal dimension of each said tubular piece, a longitudinal dimension of each boring reserved in the first rigid unit to accept a tubular piece, and a longitudinal dimension of the inner cylindrical element are each determined such that each said drilled element, and its stop intended to impede its extraction from the second rigid unit resists the material making up said second rigid unit without said material impeding the passage of a strand.

41. The device of claim 40, further comprising:

a plurality of caps that cover, in a water-tight manner, an assembly which, made up of an immobilisation piece of an end of one said strand and said end of one said strand, is accessible from the one of the opposite faces of the first rigid unit.

42. A method for obtaining a device for anchoring an end of a stay to a base, this stay end comprising at least two strands that diverge from a longitudinal axis of the stay such as to become anchored in the device, said strands each being made up of a core wire and a protective sheathing, the device being intended to be positioned and immobilised in translation in a boring provided in the base, the method comprising:

providing a first unit that is provided which is delimited transversally by a cylindrical face and longitudinally by two opposite faces substantially orthogonal to a longitudinal axis of the said first unit, the first unit being traversed by perforations, made substantially parallel to the longitudinal axis, which are each intended for the passage of an end of one said stay strand, said end being devoid of sheathing and each comprising a bearing surface to co-operate with an immobilisation piece of such said end devoid of sheathing, and bearing at least one tubular element to cover, over a certain distance measured from one of said opposite faces, a bundle of said strands in a water-tight way at least in its part where the strands are devoid of sheathing, and providing a second rigid unit, substantially cylindrical, which is built against one said opposite face of the first unit, which is the face for bearing at least one tubular element to cover the bundle of strands at least in its part where the strands are devoid of sheathing, which second rigid unit is rigidly connected to said first unit, this second rigid unit having at least two channels that extend substantially parallel, each in the prolongation of a perforation of the first unit, each having one of their ends which is connected in a water-tight way to the first unit and the other end bearing, a first locally water-tight pressing surface around the sheath covering the core wire of one said strand when engaged in the channel, and a second surface of lateral support for the sheath of a strand provided with a view to the deviation of this strand from the axis of the channel which receives it toward the longitudinal axis of the stay end.

43. The method of claim 42, further comprising, for constructing the second unit, the steps of:

providing tubular pieces, then connecting each of the tubular pieces by an end thereof to the first unit in a water-tight way and such that a channel of each said tubular piece is situated in an axis of one said perforation of the first unit, providing an outer tubular element formed by a rigid tubular wall delimited by an inner cylindrical face, an outer cylindrical face and two opposite, annular end faces, and connecting said tubular element in a rigid way to the first unit such that it delimits a volume around the tubular pieces, providing drilled elements, each of which bears, on the one hand, a surface of lateral support for the sheath provided in view of the deviation of the strand, and, on the other hand, a locally water-tight pressing surface around the strand sheath, and at the very latest after having connected the outer tubular element to the first unit, the second end of each tubular piece being equipped with one of said drilled elements, and providing a material that can be cast in a mold and hardened before being introduced into an internal volume of the tubular element and around the tubular pieces to confine said drilled elements without obstructing them.

44. The method of claim 42, further comprising the steps of:

providing tubular pieces and drilled elements that each bear, on the one hand, a lateral support surface for the sheath, provided in view of the deviation of a strand, and, on the other hand, a locally water-tight pressing surface around the strand sheath, and equipping one of said ends with one of these said drilled elements, connecting the tubular pieces, having been equipped with drilled elements at the one of their ends, by the other end thereof to the first unit in a water-tight way and such that the channel of each tubular piece is situated in an axis of one said perforation of said first unit, providing an outer tubular element, formed by a rigid tubular wall delimited by an inner cylindrical face, an outer cylindrical face and two opposite annular end faces, and connecting said tubular element in a rigid way to the first unit such that it delimits a volume around the tubular pieces, and providing a material that can be cast in a mold and hardened before being introduced into the internal volume of the outer tubular element and around the tubular pieces to confine the drilled elements without obstructing them.

* * * * *